US006075354A

United States Patent [19]

Smith et al.

[11] Patent Number: 6,075,354

[45] Date of Patent: Jun. 13, 2000

[54] PRECISION VOLTAGE REFERENCE CIRCUIT WITH TEMPERATURE COMPENSATION

[75] Inventors: Gregory J. Smith; Paul Mike Henry; Yinming Chen, all of Tucson, Ariz.

[73] Assignee: National Semiconductor Corporation, Santa Clara, Calif.

[21] Appl. No.: 09/366,237

[22] Filed: Aug. 3, 1999

[51] Int. Cl.[7] ..... G05F 3/16; G05F 3/20

[52] U.S. Cl. ..... 323/313; 323/907

[58] Field of Search ..... 323/312, 313, 323/907, 314

[56] References Cited

U.S. PATENT DOCUMENTS

| | | | |
|---|---|---|---|
| 4,603,291 | 7/1986 | Nelson | 323/315 |
| 4,751,454 | 6/1988 | Dielacher et al. | 323/314 |
| 5,220,288 | 6/1993 | Brooks | 330/255 |
| 5,319,370 | 6/1994 | Signore et al. | 341/120 |
| 5,440,305 | 8/1995 | Signore et al. | 341/120 |
| 5,530,399 | 6/1996 | Chambers et al. | 327/561 |
| 5,712,557 | 1/1998 | Gehrt et al. | 323/316 |

OTHER PUBLICATIONS

Creager, Gray, *Xicor Application Notes AN44: Variable Precision References using DCPs*, Jul. 1996, pp. 1–7 (http://www.xicor.com/products/Appnotes/AN044.html).

*Primary Examiner*—Shawn Riley
*Assistant Examiner*—Bao Q. Vu
*Attorney, Agent, or Firm*—Baker & McKenzie

[57] ABSTRACT

A precision voltage reference circuit for generating a constant reference voltage over a range of operating temperatures uses a bandgap voltage generator which is compensated with replicated currents fed back from the bandgap stage as control currents. These currents are attenuated and fed back in proper proportions to correct for bias conditions which would otherwise vary with temperature.

28 Claims, 2 Drawing Sheets

PRECISION VOLTAGE REFERENCE CIRCUIT WITH TEMPERATURE COMPENSATION

BACKGROUND OF THE INVENTION

1. Field of the Invention

The present invention relates to precision voltage reference circuits, and in particular, to precision voltage reference circuits which are compensated for variations in operating temperatures by using gain trimming techniques.

2. Description of the Related Art

Precision voltage reference circuits that operate at power supply voltages of 5 volts or less generally use circuits employing the well known bandgap principle. Many conventional bandgap reference circuit designs exist which employ one or both of BJT (bipolar junction transistor) and CMOS (complementary metal oxide semiconductor) technologies. The BJT technology has many inherent advantages. For example, the higher gain characteristics of BJTs makes them more suitable for amplifier stages with greater gain, lower noise, lower offsets and greater output drive capability. The availability of complementary BJT types (e.g., NPN and PNP) provides for gain within the $\Delta$Vbe core circuit and minimizes the contributions of amplifier noise and offset errors.

Technology for BJTs has progressed to the point where the limiting factors in the ultimate performance characteristics of the circuits have become performance shifts that occur during package assembly and package aging. While trimming techniques do exist (such as laser trimming of thin film resistors) that provide for some extreme performance ranges and resolutions, these pre-assembly trimming techniques are inadequate for overcoming performance shifts caused by the mechanical stresses of package assembly. These shifts limit the yield of the highest grade of voltage references (i.e., those with performance variations of less than 5 parts per million per degree centigrade) and, therefore, increase the cost of manufacturing.

A further major contributor to the cost of precision references is the need for characterizing each unit over several temperatures so as to guarantee performance within specified ranges of temperatures. Without temperature testing, anomalies that affect the idealized relationship between the room temperature value of the circuit output and the associated values over temperature would result in the shipping of an unacceptable proportion of defective units, i.e., units which did not maintain the desired reference voltage output within the narrow specified voltage range over the full range of operating temperatures. Moreover, temperature testing of the units in production quantities requires not only multiple handling of the units at various temperatures, but also the tracking of the individual units during such testing.

One conventional trimming technique does exist which provides for post-assembly trimming of a voltage reference, as disclosed in U.S. Pat. No. 4,751,454 (incorporated herein by reference). However, such a trimming technique provides no tracking of the output reference voltage and provides limited compensation for the complex voltage variation characteristics of the output reference voltage over temperature. Accordingly, it would be desirable to have a precision voltage reference circuit with temperature compensation that tracks the output reference voltage and has sufficiently complex tracking characteristics to compensate for the complex variation characteristics of the output reference voltage.

SUMMARY OF THE INVENTION

The precision voltage reference circuit for generating a constant reference voltage over a range of operating temperatures in accordance with the present invention tracks the bandgap reference voltage and provides complex (e.g., quadratic) temperature compensation. In a preferred embodiment, the superior performance of BJT circuits for generating bandgap reference cells and low-noise, high gain and high current drive circuits is combined with the density of CMOS non-volatile registers and weighted current attenuation networks to provide post-assembly gain trimming, thereby resulting in reference voltage accuracies previously unavailable with one individual transistor technology.

The trimming of the gain and first and second order temperature coefficients of the reference voltage is accomplished by the replication of bias currents that track the basic biasing currents controlling the operating conditions of the bandgap reference voltage generation. These replica currents are attenuated by CMOS current dividers which are controlled by the non-volatile registers. The attenuated currents are fed back to the bandgap voltage generator circuit in the proper proportion to correct the non-ideal bias conditions of the circuit. The state of the non-volatile register is serially programmed to the optimal code following final assembly of the circuit so as to remove errors introduced by packaging stresses.

In accordance with one embodiment of the present invention, a precision voltage reference circuit for generating a substantially constant reference voltage over a range of operating temperatures includes a current source circuit, a bandgap voltage generator circuit and a control circuit. The current source circuit is configured to generate a plurality of source currents. The bandgap voltage generator circuit, coupled to the current source circuit, is configured to receive a portion of the plurality of source currents and a plurality of control signals and in accordance therewith provide a reference voltage over a defined range of operating temperatures. The control circuit, coupled to the current source circuit and the bandgap voltage generator circuit, is configured to receive another portion of the plurality of source currents and in accordance therewith provide the plurality of control signals. Absent reception of the control signals, the bandgap voltage generator circuit generates the reference voltage with a substantially quadratic voltage-versus-temperature characteristic in which the reference voltage varies over the defined range of operating temperatures in accordance with gain, slope and slope curvature components. The plurality of control signals includes three control signals. The first control signal corresponds to the gain component, the second control signal corresponds to the slope component and the third control signal corresponds to the slope curvature component. The bandgap voltage generator circuit, in accordance with the first, second and third control signals, provides the reference voltage at a substantially constant magnitude over the defined range of operating temperatures.

In accordance with another embodiment of the present invention, a precision voltage reference circuit for generating a substantially constant reference voltage over a range of operating temperatures includes a current source circuit, a bandgap voltage generator circuit, a voltage amplifier circuit and a control circuit. The current source circuit is configured to generate a source current. The bandgap voltage generator circuit, coupled to the current source circuit, is configured to receive a portion of the source current and a portion of a plurality of control signals and in accordance therewith provide a reference voltage over a defined range of operating temperatures. The voltage amplifier circuit, coupled to the bandgap voltage generator circuit, is configured to receive the reference voltage and another portion of the plurality of control signals and in accordance therewith provide a buffered reference voltage. The control circuit, coupled to the current source circuit, the bandgap voltage generator circuit and the voltage amplifier circuit, is configured to receive another portion of the source current and in accordance therewith provide the plurality of control signals. Absent reception of the control signals, the bandgap voltage generator circuit and the voltage amplifier circuit together generate the buffered reference voltage with a substantially quadratic voltage-versus-temperature characteristic in which the buffered reference voltage varies over the defined range of operating temperatures in accordance with gain, slope and slope curvature components. The plurality of control signals includes three control signals. The first control signal corresponds to the gain component, the second control signal corresponds to the slope component and the third control signal corresponds to the slope curvature component. The bandgap voltage generator circuit and the voltage amplifier circuit together, in accordance with the first, second and third control signals, provide the buffered reference voltage at a substantially constant magnitude over the defined range of operating temperatures.

In accordance with still another embodiment of the present invention, a precision voltage reference circuit for generating a substantially constant reference voltage over a range of operating temperatures includes a bandgap voltage generator circuit, a voltage amplifier circuit and a control circuit. The bandgap voltage generator circuit is configured to receive a portion of a plurality of control signals and in accordance therewith provide a reference voltage over a defined range of operating temperatures. The voltage amplifier circuit, coupled to the bandgap voltage generator circuit, is configured to receive the reference voltage and another portion of the plurality of control signals and in accordance therewith provide a buffered reference voltage. The control circuit, coupled to the bandgap voltage generator circuit and the voltage amplifier circuit, is configured to receive the reference voltage and in accordance therewith provide the plurality of control signals. Absent reception of the control signals, the bandgap voltage generator circuit and the voltage amplifier circuit together generate the buffered reference voltage with a substantially quadratic voltage-versus-temperature characteristic in which the buffered reference voltage varies over the defined range of operating temperatures in accordance with gain, slope and slope curvature components. The plurality of control signals includes three control signals. The first control signal corresponds to the gain component, the second control signal corresponds to the slope component and the third control signal corresponds to the slope curvature component. The bandgap voltage generator circuit and the voltage amplifier circuit together, in accordance with the first, second and third control signals, provide the buffered reference voltage at a substantially constant magnitude over the defined range of operating temperatures.

These and other features and advantages of the present invention will be understood upon consideration of the following detailed description of the invention and the accompanying drawings.

DETAILED DESCRIPTION OF THE INVENTION

Figure 1:
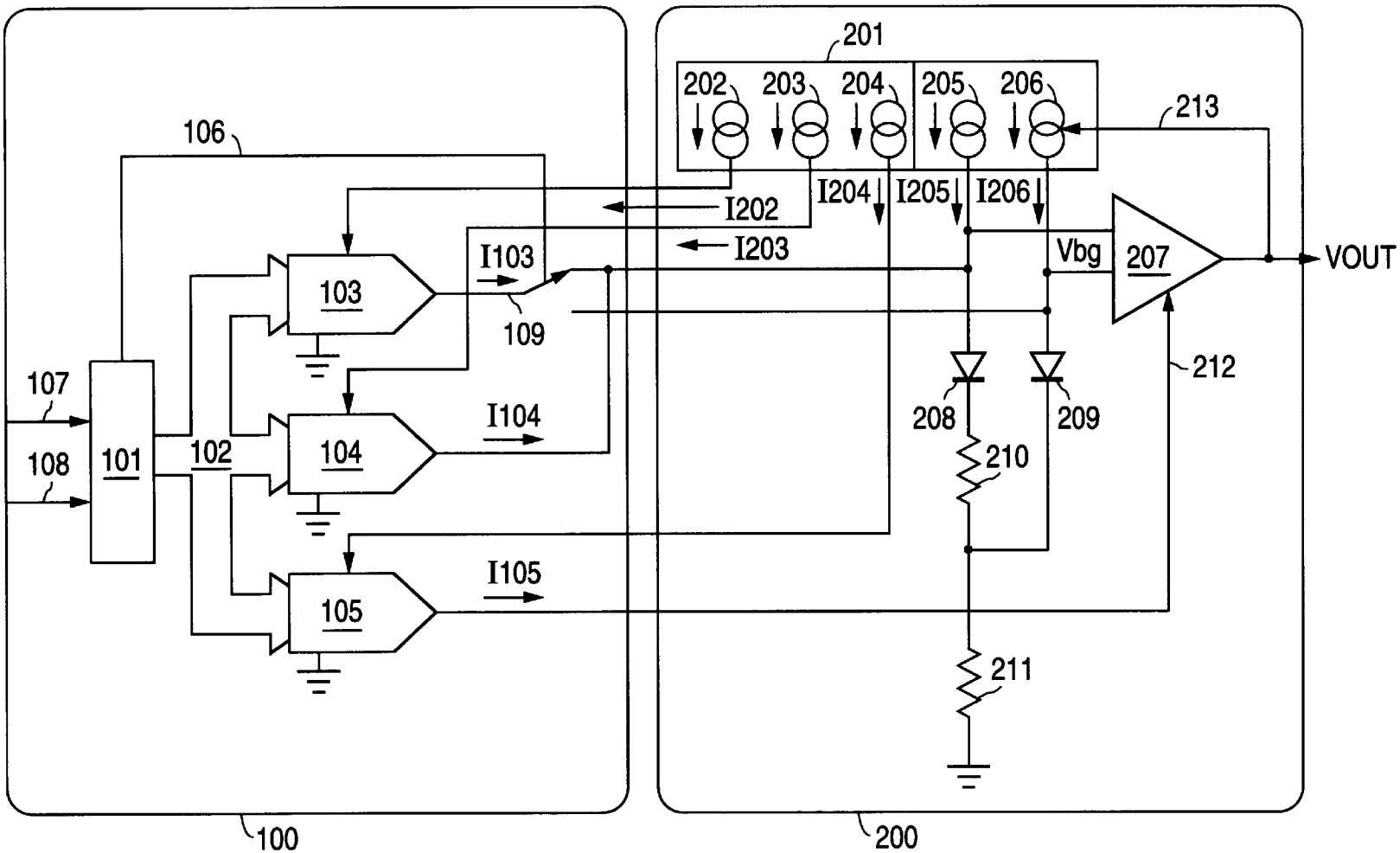
FIG. 1 is a functional block diagram of a precision voltage reference circuit in accordance with one embodiment of the present invention.

Referring to FIG. 1, a precision voltage reference circuit in accordance with one embodiment of the present invention includes two blocks 100, 200 of circuitry. Circuit block 100 is implemented using CMOS technology, while circuit block 200 is implemented using analog BJT technology. Together, these circuit blocks 100, 200 form the precision voltage reference circuit.

Within circuit block 100, there is a non-volatile memory circuit 101 for storing the range of possible correction codes for trimming the output reference voltage to the required resolution within the specified range of operating temperatures. Signal lines 107 and 108 are serial interface lines to the memory 101 for loading trial codes into the memory 101 during testing and trimming. Signal bus 102 provides routing of the trimming codes from the memory 101 to three digital-to-analog conversion circuits (DACs) 103, 104, 105. An additional signal line 106 is provided for controlling a switch 109 at the output of DAC 103.

The first DAC 103 provides trimming for first-order temperature slope adjustment of the output reference voltage VOUT. The second DAC 104 provides trimming for second-order temperature slope curvature adjustment of the output reference voltage VOUT. The third DAC 105 provide scalar gain adjustment for scaling the magnitude of the reference output voltage VOUT. The polarity of the first-order temperature slope adjustment is controlled, via switch 109, by selecting the output path for the adjustment signal from DAC 103. Within the analog BJT circuit block 200, a bank 201 of current sources 202, 203, 204, 205, 206 is provided. Current sources 205 and 206 are matched; therefore, while the relative magnitudes and temperature coefficients of these current sources 205, 206 may differ, their output currents I205, I206 track the magnitude of the feedback control signal 213 (the reference output voltage VOUT), as well as track each other in a predictable manner over temperature and process parameter variation (e.g., resistor sheet conductivity, transistor gain, Early voltage, etc.).

The bandgap core circuit is of conventional design, with diodes 208 and 209, resistors 210 and 211, and operational amplifier 207. Currents I205 and I206 from current sources 205 and 206, respectively, are balanced bias currents which establish the uncompensated performance of the bandgap core circuit elements 208, 209, 210, 211. Operational amplifier 207 has an adjustable gain that stabilizes the bias of the bandgap core circuitry and buffers the output to provide the output reference voltage VOUT. Diodes 208 and 209 (alternatively, diode-connected bipolar transistors), as is well known in the art, establish a PTAT (proportional to absolute temperature) voltage that approximates the bandgap of silicon. The bipolar junction area of diode 208 is approximately ten times the diode junction area of diode 209. Resistor 210 is the ΔVbe dropping resistor, while resistor 211 "gains" the voltage drop of resistor 210 such that the magnitude of the PTAT voltage counters the temperature contribution of the ΔVbe component of the bandgap core circuit elements 208, 209, 210, 211. The gain of operational amplifier 207 is initially set to VOUT/Vbg.

Currents I202, I203 and I204 are used by DACs 103, 104 and 105 to generate correction currents I103, I104 and I105, respectively. Each of these correction currents I103, I104, I105 is proportional to their respective input currents I202, I203, I204 in accordance with the respective input correction data provided to the DACs 103, 104, 105 via the memory bus 102. Correction current I103 provides tracking correction current for the first-order slope of the reference voltage VOUT. Correction current I104 provides tracking correction current for the second-order slope curvature of the reference voltage VOUT. The characteristics of this current I104 compensate for the well-known Vbe (i.e., forward bias bipolar junction voltage) curvature which occurs over variations in temperature. Correction current I105 provides tracking correction current for adjusting the gain A of the buffer amplifier 207. As noted above, the complex temperature variation characteristic of the reference voltage VOUT is substantially quadratic: $A+BT+CT^2$ (where T=temperature). Accordingly, correction current I105 compensates for the gain A, correction current I103 compensates for the first-order slope factor B, and correction current I104 compensates for the slope curvature factor C.

Alternatively, as should be recognized, DACs 103, 104 and 105 can provide correction voltages V103, V104 and V105, respectively. For example, in accordance with conventional circuit design techniques, the circuitry for current sources 205 and 206 can be designed to be appropriately influenced by correction voltages V103 and V104 and thereby provide appropriately controlled values of output currents 205 and 206 to diodes 208 and 209, respectively. Similarly, the circuitry for buffer amplifier 207 can be designed to be appropriately influenced by correction voltage V105 for providing an appropriately controlled signal gain.

Figure 2:
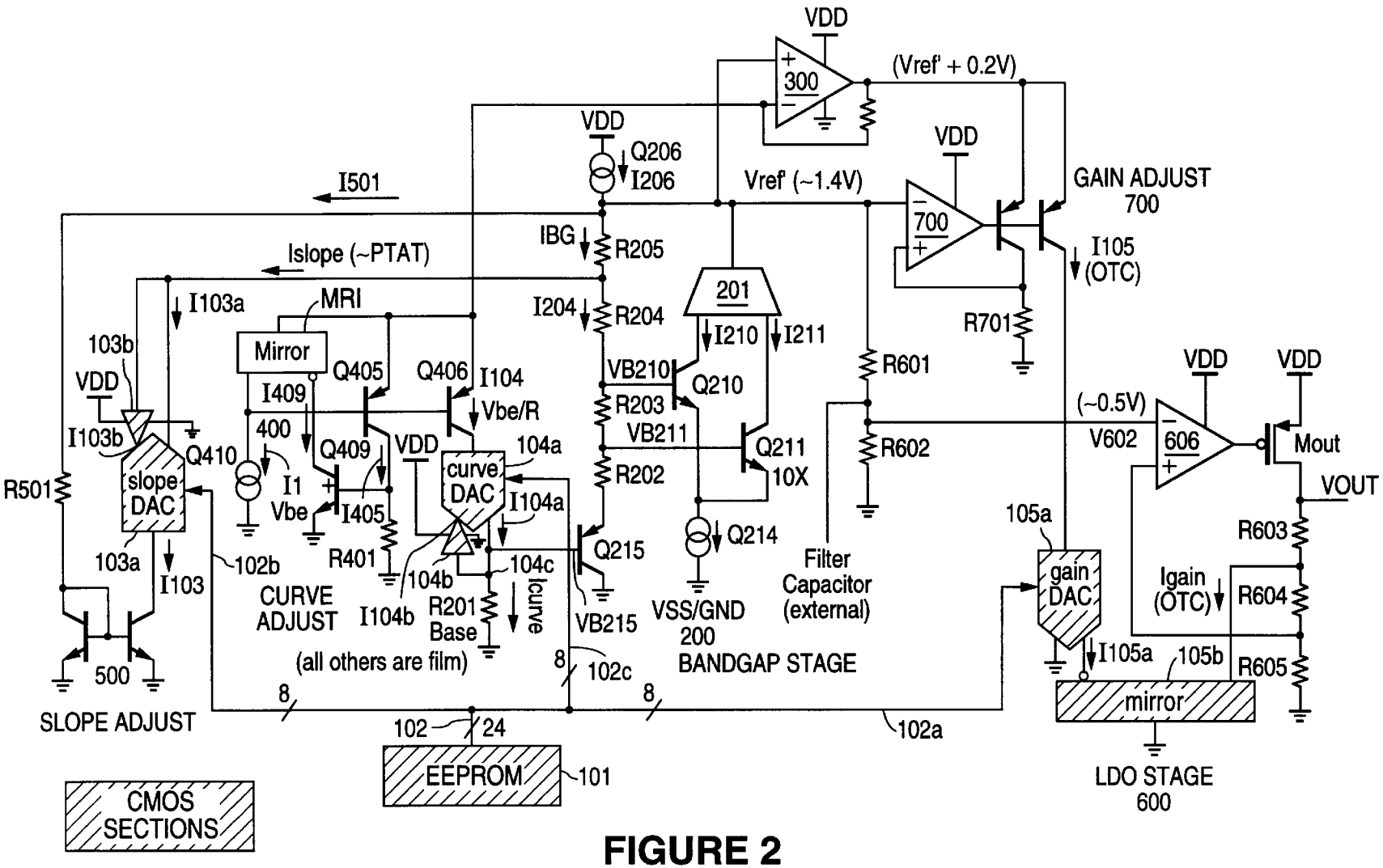
FIG. 2 is a schematic diagram of a precision voltage reference circuit in accordance with another embodiment of the present invention.

Referring to FIG. 2, a precision voltage reference circuit in accordance with another embodiment of the present invention also uses CMOS and BJT circuits. The CMOS circuitry includes a memory in the form of an EEPROM (electrically erasable programmable read only memory) 101, a slope DAC 103*a* (with buffer circuit 103*b*), a curve DAC 104*a* (with buffer circuit 104*b*), a gain DAC 105*a*, and a current mirror circuit 105*b*, plus a P-type MOS output transistor Mout. The remaining circuitry is implemented using bipolar technology.

Current source Q206 provides a source current I206 which splits into currents I501 and IBG (among others not shown). Current I501 serves as the input driving current for a current mirror circuit within the slope adjust stage 500 which drives the slope DAC 103*a*. Current IBG serves as the primary biasing current for the bandgap stage 200 (discussed in more detail below). This current IBG, in conjunction with the contribution of the slope correction current Islope generated by the slope DAC 103*a*, establish the base voltages VB210, VB211 for biasing the bandgap transistors Q210, Q211. (Transistor Q211 has an emitter ten times as large as the emitter area of transistor Q210.) A feedback amplifier 201 operates to ensure that currents I210 and I211 through transistors Q210 and Q211, respectively, remain equal, thereby generating the bandgap-related voltage Vref' at its output. This bandgap-related voltage Vref' influences how current I206 is distributed between the input current I501 to the slope adjust stage 500 and the bias current IBG to the bandgap stage 200. Accordingly, the supply current I501 to the slope adjust stage 500 serves as a replica current which is related to the bandgap-related voltage Vref' and ensures that the bandgap-related voltage Vref' is well centered with respect to the slope correction available through the use of the slope DAC 103*a*.

More specifically, the bandgap stage 200 operates as a bandgap-based reference voltage generator circuit which provides an increased output bandgap-related reference voltage Vref' (i.e., higher than a conventional bandgap voltage Vbg) and has a reduced second order temperature coefficient. Current I104*a* has a negative temperature coefficient (discussed in more detail below) and is conducted by resistor R201. Resistor R201 is formed by the P-type diffusion that forms the base regions of the NPN bipolar junction transistors and, therefore, has a positive temperature coefficient. The resultant voltage VB215 across resistor R201 serves as a curvature correction bias voltage. This voltage VB215 has an arcuate voltage-versus-temperature characteristic with a direction of incurvature that is substantially opposite the direction of incurvature of the corresponding arcuate voltage-versus-temperature characteristic of the voltage generated by a conventional bandgap reference voltage generator circuit. This voltage VB215 is summed with the voltages generated across the base-emitter junction of transistor Q215 and resistors R202, R203, R204 and R205 to produce the bandgap-based reference voltage Vref' which is greater in magnitude than a conventional bandgap reference voltage and has a significantly reduced second order temperature coefficient. (Further details about this bandgap stage 200 can be found in commonly assigned, co-pending U.S. patent application Ser. No. 09/368,104, entitled "Bandgap-Based Reference Voltage Generator Circuit With Reduced Temperature Coefficient," filed on even date herewith, the disclosure of which is incorporated herein by reference.)

The sinking current I103 generated within the slope adjust stage 500 drives the slope correction DAC 103*a* which is a multiplying DAC. In accordance with the slope correction data 102*b*, the slope DAC 103*a* sinks DAC input current I103*a* (which is the slope correction current Islope) plus an additional current I103*b* which is provided by buffer amplifier 103*b* as needed (depending upon the multiplication factor for the DAC 103*a* due to the correction data 102*b*, i.e., I103=I103*a*+I103*b*).

Within the curve adjust stage 400, the curve DAC 104*a* scales its input current I104 in accordance with curvature correction data 102*c* to source the current I104*a* which causes the curvature correction bias voltage VB215 to be generated across resistor R201 (as discussed above). Buffer amplifier 104*b* sinks additional output current I104*b* from the DAC 104*a* as needed (depending upon the multiplication factor for the DAC 104*a* due to the correction data 102*c*, i.e., I104=I104*a*+I104*b*).

More specifically, the curve adjust stage 400 generates the DAC input current I104 with a negative temperature coefficient. A current sink circuit Q410 loads the output of a current mirror circuit MR1 such that a negative feedback voltage is generated to bias the base terminal of a PNP transistor Q405. The collector current I405 of this transistor Q405 is conducted through a resistor R401 across which is thereby generated a forward bias voltage Vbe for the base-emitter junction an NPN transistor Q409. The collector current I409 of this transistor Q409 is the input current for the current mirror circuit MR1. (Further details about this curve adjust stage 400 can be found in commonly assigned, co-pending U.S. patent application Ser. No. 09/368,321, entitled "Low Voltage Circuit For Generating Current With A Negative Temperature Coefficient," filed on even date herewith, the disclosure of which is incorporated herein by reference.)

The bandgap-related voltage Vref' drives the gain adjust stage 700 which provides temperature compensated (OTC) drive current I105 for the gain DAC 105*a*. The output transistors of the gain adjust stage 700 have their emitter terminals biased through amplifier 300 which, in turn, is driven by the bandgap-related voltage Vref'. (This amplifier 300 is used for purposes of enhancing stability of the circuit; alternatively, these emitter terminals can be biased directly from the power supply voltage VDD.) The bandgap-related voltage Vref' is also divided down through a voltage divider (resistors R601 and R602) and filtered (by an external filter capacitor) for driving the LDO (low dropout) stage 600.

The LDO stage 600 buffers this voltage V602 to generate the buffered voltage used as the reference voltage VOUT. The final value of this output voltage VOUT is compensated by the temperature compensated (OTC) gain compensation current Igain generated by the gain DAC 105*a* and current mirror circuit 105*b*. This correction current Igain is determined in accordance with the correction data 102*a* which is multiplied in the multiplying gain DAC 105*a* to generate an appropriate input current I105*a* for the current mirror circuit 105*b*.

In terms of the correction currents Igain, Icurve and Islope, as well as the bandgap-related voltage Vref' and resistive circuit elements, the output voltage VOUT is determined in accordance with the following equations.

$$V_{out} = Igain * R603 + G * (Vref'' + Icurve * R201 + Islope * R205)$$

$$G = \frac{R602(R603 + R604 + R605)}{R605(R601 + R602)}$$

$$Vref'' = Vbe_{Q215} + \frac{(R202 + R203 + R204 + R205)}{R203} * (Vbe_{Q210} - Vbe_{Q211})$$

The merging of the BJT and CMOS circuit blocks can be implemented in a number of ways. One technique would be the use of a BiCMOS process where both bipolar and CMOS devices would be integrated in a monolithic integrated circuit. Another technique would be the assembly of multiple circuit chips within one package. Such a multiple chip approach may be more desirable for low cost manufacturing. For example, one bipolar chip and one CMOS chip can be assembled in a 6 mm square package with the only additional expense of two die attach operations and some additional wire bonds. As depicted in FIG. 1, for example, the number of chip-to-chip wire bonds can be as low as 6, i.e., only 6 interconnects are needed between CMOS circuit block 100 and BJT circuit block 200.

Based upon the foregoing, it can be seen that a precision voltage reference circuit in accordance with the present invention takes advantage of the superior characteristics of bipolar junction technology combined with the ability to use CMOS circuits to trim the performance characteristics of the circuit after assembly and packaging. The combination of BJT and CMOS devices with non-volatile memory provides the ability to provide inexpensive post-assembly trimming with reasonable range and resolution characteristics. The memory array 101 can be made accessible through a serial data pin on the package. Following characterization at multiple temperatures, each unit can be trimmed to its individual optimum bias condition for slope, gain and second-order nonlinear characteristics.

Additional advantages are also realized. For example, the non-volatile memory can serve as a "scratch pad" memory for identifying each unit during testing until the final trim code has been loaded and saved. Further, this ability to trim accuracy following assembly allows performance shifts caused by assembly to be avoided, while also allowing accuracy to be trimmed to much tighter values without yield losses due to such post-assembly performance variations. Further still, this allows the circuit performance to be trimmed after it has been mounted on the final printed circuit board. As is well-known, the soldering process often introduces additional performance variations in absolute accuracy due to the temperature exposure caused by the soldering process as well as the residual mechanical stresses exerted by the printed circuit board. Such performance variations can be removed by trimming out such induced errors following mounting on the printed circuit board.

Various other modifications and alterations in the structure and method of operation of this invention will be apparent to those skilled in the art without departing from the scope and spirit of the invention. Although the invention has been described in connection with specific preferred embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. An apparatus including a precision voltage reference circuit for generating a substantially constant reference voltage over a range of operating temperatures, comprising:

a current source circuit configured to generate a plurality of source currents;

a bandgap voltage generator circuit, coupled to said current source circuit, configured to receive a portion of said plurality of source currents and a plurality of control signals and in accordance therewith provide a reference voltage over a defined range of operating temperatures; and a control circuit, coupled to said current source circuit and said bandgap voltage generator circuit, configured to receive another portion of said plurality of source currents and in accordance therewith provide said plurality of control signals;

wherein:

absent said reception of said plurality of control signals, said bandgap voltage generator circuit generates said reference voltage with a substantially quadratic voltage-versus-temperature characteristic in which said reference voltage varies over said defined range of operating temperatures in accordance with gain, slope and slope curvature components;

said plurality of control signals includes a first control signal which corresponds to said gain component, a second control signal which corresponds to said slope component, and a third control signal which corresponds to said slope curvature component; and said bandgap voltage generator circuit, in accordance with said first, second and third control signals, provides said reference voltage at a substantially constant magnitude over said defined range of operating temperatures.

2. The apparatus of claim 1, wherein said current source circuit is further configured to receive said reference voltage and in accordance therewith generate said plurality of source currents.

3. The apparatus of claim 1, wherein said current source circuit comprises a current mirror circuit.

4. The apparatus of claim 1, wherein said bandgap volt age generator circuit comprises:

a bandgap stage configured to receive said second and third control signals and in accordance therewith generate a plurality of bandgap signals; and a variable gain voltage buffer stage, coupled to said bandgap stage, configured to receive said first control signal and said plurality of bandgap signals and in accordance therewith generate said reference voltage.

5. The apparatus of claim 1, wherein said control circuit comprises a plurality of digital-to-analog conversion (DAC) circuits configured to provide said plurality of control signals.

6. The apparatus of claim 5, wherein:

said plurality of DAC circuits is further configured to receive a plurality of control data and in accordance therewith provide one or more control currents as said plurality of control signals; and said control circuit further comprises a memory circuit, coupled to said plurality of DAC circuits, configured to provide said plurality of control data.

7. The apparatus of claim 5, wherein said plurality of DAC circuits comprises:

a first DAC circuit configured to receive a first plurality of control data and a first one of said plurality of source currents and in accordance therewith provide a first control current as a first one of said plurality of control signals;

a second DAC circuit configured to receive a second plurality of control data and a second one of said plurality of source currents and in accordance therewith provide a second control current as a second one of said plurality of control signals; and a third DAC circuit configured to receive a third plurality of control data and a third one of said plurality of source currents and in accordance therewith provide a third one of said plurality of control signals.

8. The apparatus of claim 7, wherein said control circuit further comprises a memory circuit, coupled to said first, second and third DAC circuits, configured to provide said first, second and third pluralities of control data.

9. The apparatus of claim 1, wherein:

said bandgap voltage generator circuit includes first and second current paths configured to receive said portion of said plurality of source currents and said second and third control signals; and said control circuit includes a switch circuit with first and second switching states and configured to provide said second and third control signals as first and second currents, provide said first and second currents to said first and second current paths, respectively, in accordance with said first switching state, and provide said first and second currents to said first current path in accordance with said second switching state.

10. The apparatus of claim 1, wherein said plurality of control signals comprises a plurality of currents.

11. An apparatus including a precision voltage reference circuit for generating a substantially constant reference voltage over a range of operating temperatures, comprising:

a current source circuit configured to generate a source current;

a bandgap voltage generator circuit, coupled to said current source circuit, configured to receive a portion of said source current and a portion of a plurality of control signals and in accordance therewith provide a reference voltage over a defined range of operating temperatures;

a voltage amplifier circuit, coupled to said bandgap voltage generator circuit, configured to receive said reference voltage and another portion of said plurality of control signals and in accordance therewith provide a buffered reference voltage; and a control circuit, coupled to said current source circuit, said bandgap voltage generator circuit and said voltage amplifier circuit, configured to receive another portion of said source current and in accordance therewith provide said plurality of control signals;

wherein:

absent said receptions of said portions of said plurality of control signals, said bandgap voltage generator circuit and said voltage amplifier circuit together generate said buffered reference voltage with a substantially quadratic voltage-versus-temperature characteristic in which said buffered reference voltage varies over said defined range of operating temperatures in accordance with gain, slope and slope curvature components;

said plurality of control signals includes a first control signal which corresponds to said gain component, a second control signal which corresponds to said slope component, and a third control signal which corresponds to said slope curvature component; and said bandgap voltage generator circuit and said voltage amplifier circuit together, in accordance with said first, second and third control signals, provide said buffered reference voltage at a substantially constant magnitude over said defined range of operating temperatures.

12. The apparatus of claim 11, wherein said bandgap voltage generator circuit comprises:

a biasing stage configured to receive said portion of said source current, said reference voltage and said second and third control signals and in accordance therewith provide a plurality of bias signals;

a bandgap stage, coupled to said biasing stage, configured to receive said plurality of bias signals and in accordance therewith generate a plurality of bandgap signals; and a feedback stage, coupled to said bandgap stage and said biasing stage, configured to receive said plurality of bandgap signals and in accordance therewith generate said reference voltage.

13. The apparatus of claim 11, wherein said voltage amplifier circuit comprises:

a current supply circuit configured to receive said reference voltage and in accordance therewith provide a supply current at a substantially constant magnitude over said defined range of operating temperatures; and a voltage buffer circuit configured to receive said reference voltage and said another portion of said plurality of control signals and in accordance therewith provide said buffered reference voltage.

14. The apparatus of claim 13, wherein:

said another portion of said plurality of control signals comprises a current signal; and said voltage buffer circuit includes an output stage configured to generate and sum an output current with said current signal.

15. The apparatus of claim 11, wherein said control circuit comprises a plurality of digital-to-analog conversion (DAC) circuits configured to provide said plurality of control signals.

16. The apparatus of claim 15, wherein:

said plurality of DAC circuits is further configured to receive a plurality of control data and in accordance therewith provide one or more control currents as said plurality of control signals; and said control circuit further comprises a memory circuit, coupled to said plurality of DAC circuits, configured to provide said plurality of control data.

17. The apparatus of claim 15, wherein said plurality of DAC circuits comprises:

a first DAC circuit configured to receive a first plurality of control data and said another portion of said source current and in accordance therewith provide a control current as a first one of said plurality of control signals;

a second DAC circuit configured to receive a second plurality of control data and in accordance therewith provide a second one of said plurality of control signals; and a third DAC circuit configured to receive a third plurality of control data and in accordance therewith provide another control current as a third one of said plurality of control signals.

18. The apparatus of claim 17, wherein said control circuit further comprises a memory circuit, coupled to said first, second and third DAC circuits, configured to provide said first, second and third pluralities of control data.

19. The apparatus of claim 11, wherein said plurality of control signals comprises a plurality of currents.

20. An apparatus including a precision voltage reference circuit for generating a substantially constant reference voltage over a range of operating temperatures, comprising:

a bandgap voltage generator circuit configured to receive a portion of a plurality of control signals and in accordance therewith provide a reference voltage over a defined range of operating temperatures;

a voltage amplifier circuit, coupled to said bandgap voltage generator circuit, configured to receive said reference voltage and another portion of said plurality of control signals and in accordance therewith provide a buffered reference voltage; and a control circuit, coupled to said bandgap voltage generator circuit and said voltage amplifier circuit, configured to receive said reference voltage and in accordance therewith provide said plurality of control signals;

wherein:

absent said receptions of said portions of said plurality of control signals, said bandgap voltage generator circuit and said voltage amplifier circuit together generate said buffered reference voltage with a substantially quadratic voltage-versus-temperature characteristic in which said buffered reference voltage varies over said defined range of operating temperatures in accordance with gain, slope and slope curvature components;

said plurality of control signals includes a first control signal which corresponds to said gain component, a second control signal which corresponds to said slope component, and a third control signal which corresponds to said slope curvature component; and said bandgap voltage generator circuit and said voltage amplifier circuit together, in accordance with said first, second and third control signals, provide said buffered reference voltage at a substantially constant magnitude over said defined range of operating temperatures.

21. The apparatus of claim 20, wherein said bandgap voltage generator circuit comprises:

a biasing stage configured to receive said reference voltage and said second and third control signals and in accordance therewith provide a plurality of bias signals;

a bandgap stage, coupled to said biasing stage, configured to receive said plurality of bias signals and in accordance therewith generate a plurality of bandgap signals; and a feedback stage, coupled to said bandgap stage and said biasing stage, configured to receive said plurality of bandgap signals and in accordance therewith generate said reference voltage.

22. The apparatus of claim 20, wherein said voltage amplifier circuit comprises:

a current supply circuit configured to receive said reference voltage and in accordance therewith provide a supply current at a substantially constant magnitude over said defined range of operating temperatures; and a voltage buffer circuit configured to receive said reference voltage and said another portion of said plurality of control signals and in accordance therewith provide said buffered reference voltage.

23. The apparatus of claim 22, wherein:

said another portion of said plurality of control signals comprises a current signal; and said voltage buffer circuit includes an output stage configured to generate and sum an output current with said current signal.

24. The apparatus of claim 20, wherein said control circuit comprises a plurality of digital-to-analog conversion (DAC) circuits configured to provide said plurality of control signals.

25. The apparatus of claim 24, wherein:

said plurality of DAC circuits is further configured to receive a plurality of control data and in accordance therewith provide one or more control currents as said plurality of control signals; and said control circuit further comprises a memory circuit, coupled to said plurality of DAC circuits, configured to provide said plurality of control data.

26. The apparatus of claim 24, wherein said plurality of DAC circuits comprises:

a first DAC circuit configured to receive a first plurality of control data and said reference voltage and in accordance therewith provide a control current as a first one of said plurality of control signals;

a second DAC circuit configured to receive a second plurality of control data and in accordance therewith provide a second one of said plurality of control signals; and a third DAC circuit configured to receive a third plurality of control data and in accordance therewith provide another control current as a third one of said plurality of control signals.

27. The apparatus of claim 26, wherein said control circuit further comprises a memory circuit, coupled to said first, second and third DAC circuits, configured to provide said first, second and third pluralities of control data.

28. The apparatus of claim 20, wherein said plurality of control signals comprises a plurality of currents.

* * * * *